US011299364B2

(12) United States Patent
Rohman et al.

(10) Patent No.: US 11,299,364 B2
(45) Date of Patent: Apr. 12, 2022

(54) PADDLE ROLLER ROTATIONS

(71) Applicant: HEWLETT-PACKARD DEVELOPMENT COMPANY, L.P., Spring, TX (US)

(72) Inventors: Stephen Thomas Rohman, Vancouver, WA (US); Matthew Raisanen, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/609,459

(22) PCT Filed: May 15, 2018

(86) PCT No.: PCT/US2018/032829
§ 371 (c)(1),
(2) Date: Oct. 30, 2019

(87) PCT Pub. No.: WO2019/221720
PCT Pub. Date: Nov. 21, 2019

(65) Prior Publication Data

US 2021/0331887 A1 Oct. 28, 2021

(51) Int. Cl.
*B65H 31/36* (2006.01)
*B65H 31/02* (2006.01)
*B65H 43/00* (2006.01)

(52) U.S. Cl.
CPC ..... *B65H 31/36* (2013.01); *B65H 31/02* (2013.01); *B65H 43/00* (2013.01); *B65H 2301/4212* (2013.01); *B65H 2301/4452* (2013.01); *B65H 2404/1114* (2013.01); *B65H 2404/152* (2013.01); *B65H 2511/13* (2013.01); *B65H 2511/152* (2013.01); *B65H 2511/33* (2013.01); *B65H 2801/27* (2013.01)

(58) Field of Classification Search
CPC ..... B65H 31/36; B65H 31/02; B65H 43/00; B65H 2511/33; B65H 2404/1114
See application file for complete search history.

(56) References Cited

U.S. PATENT DOCUMENTS 4,541,626 A * 9/1985 Millen ..... B65H 9/16 271/113
4,891,652 A 1/1990 Sato et al.
5,056,771 A 10/1991 Beck et al.
5,415,390 A * 5/1995 Guerrero ..... B65H 31/34 271/215
5,609,333 A 3/1997 Mandel et al.
(Continued)

FOREIGN PATENT DOCUMENTS

JP 61002641 A * 1/1986 ..... B65H 31/34
WO WO-2019216914 A1 * 11/2019 ..... B65H 31/02

*Primary Examiner* — Patrick H Mackey
(74) *Attorney, Agent, or Firm* — Brooks Cameron & Huebsch PLLC

(57) ABSTRACT

In an example printing device may include a tray to receive print media sheets, and a paddle roller to rotate about an axis and move individual print media sheets of the print media sheets to abut an end register of the tray and form a stack of print media sheets, and the paddle roller rotate a first quantity of rotations per print media sheet based in response to a determination that the stack of print media sheets corresponds to a first height.

16 Claims, 5 Drawing Sheets

(56) References Cited

U.S. PATENT DOCUMENTS

| | | | | |
|---|---|---|---|---|
| 6,220,597 | B1 * | 4/2001 | Scibetta | A63F 3/00157 273/274 |
| 6,874,779 | B2 | 4/2005 | Park | |
| 7,448,612 | B2 | 11/2008 | Rumford et al. | |
| 7,517,045 | B2 | 4/2009 | Inoue | |
| 7,571,904 | B2 * | 8/2009 | Bober | B65H 31/36 270/58.07 |
| 7,584,953 | B2 | 9/2009 | Johnson et al. | |
| 7,591,468 | B2 | 9/2009 | Ryan et al. | |
| 8,465,016 | B2 | 6/2013 | Winburne et al. | |
| 9,708,141 | B2 * | 7/2017 | Kishi | B65H 31/38 |
| 9,932,194 | B2 * | 4/2018 | Tokuma | B65H 29/14 |
| 10,109,138 | B2 * | 10/2018 | Lundblad | G07F 19/202 |
| 10,941,013 | B2 * | 3/2021 | Egawa | B65H 29/125 |
| 11,091,344 | B2 * | 8/2021 | Ueno | B42B 4/00 |
| 2002/0008350 | A1 | 1/2002 | Adachi et al. | |
| 2008/0315495 | A1 * | 12/2008 | Taki | B65H 31/3018 271/4.02 |
| 2017/0227924 | A1 | 8/2017 | Hishida et al. | |

* cited by examiner

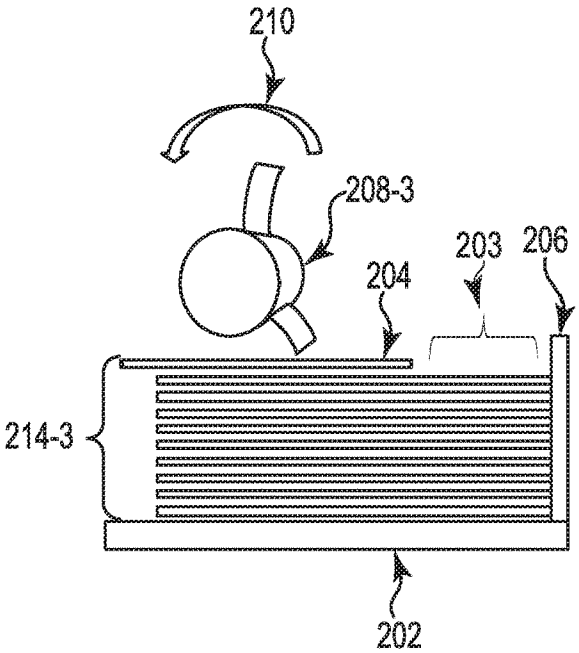
Figure 2C
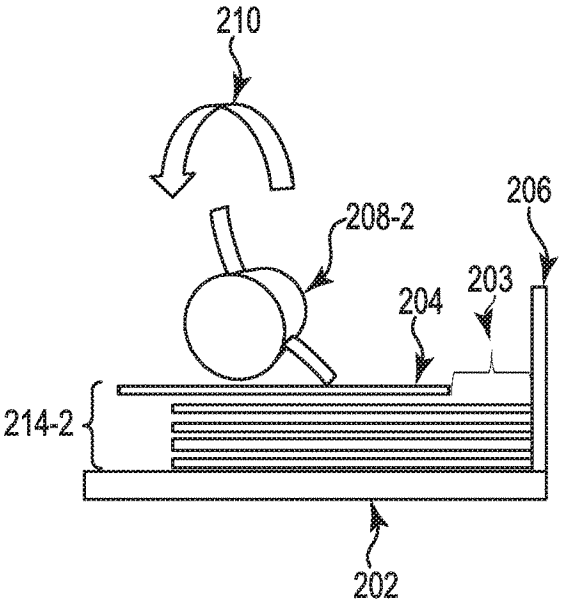
Figure 2B
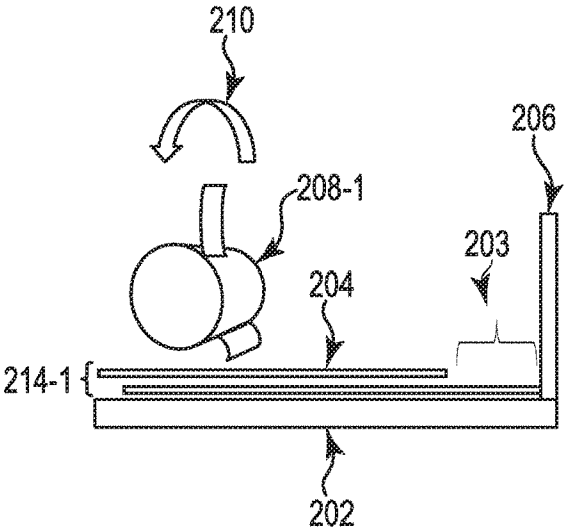
Figure 2A
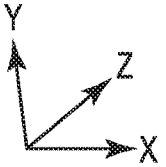

PADDLE ROLLER ROTATIONS

BACKGROUND

Imaging systems, such as printers, copiers, etc., may be used to form markings on a print medium, text, images, etc. In some examples, imaging systems may form markings on the print medium by performing a print job. A print job can include forming markings such as text and/or images by transferring a print substance (e.g., ink, toner, etc.) to the print media. The print media may be stacked on a tray after printing. The printing device may be connected to a finisher that may perform a finishing process on the stacked print media.

BRIEF DESCRIPTION OF THE DRAWINGS

FIG. 2A illustrates an example paddle roller at a starting portion of a print job.

FIG. 2B illustrates an example paddle roller at an intermediate portion of a print job.

FIG. 2C illustrates an example paddle roller at a final portion of a print job.

DETAILED DESCRIPTION

Figure 1:
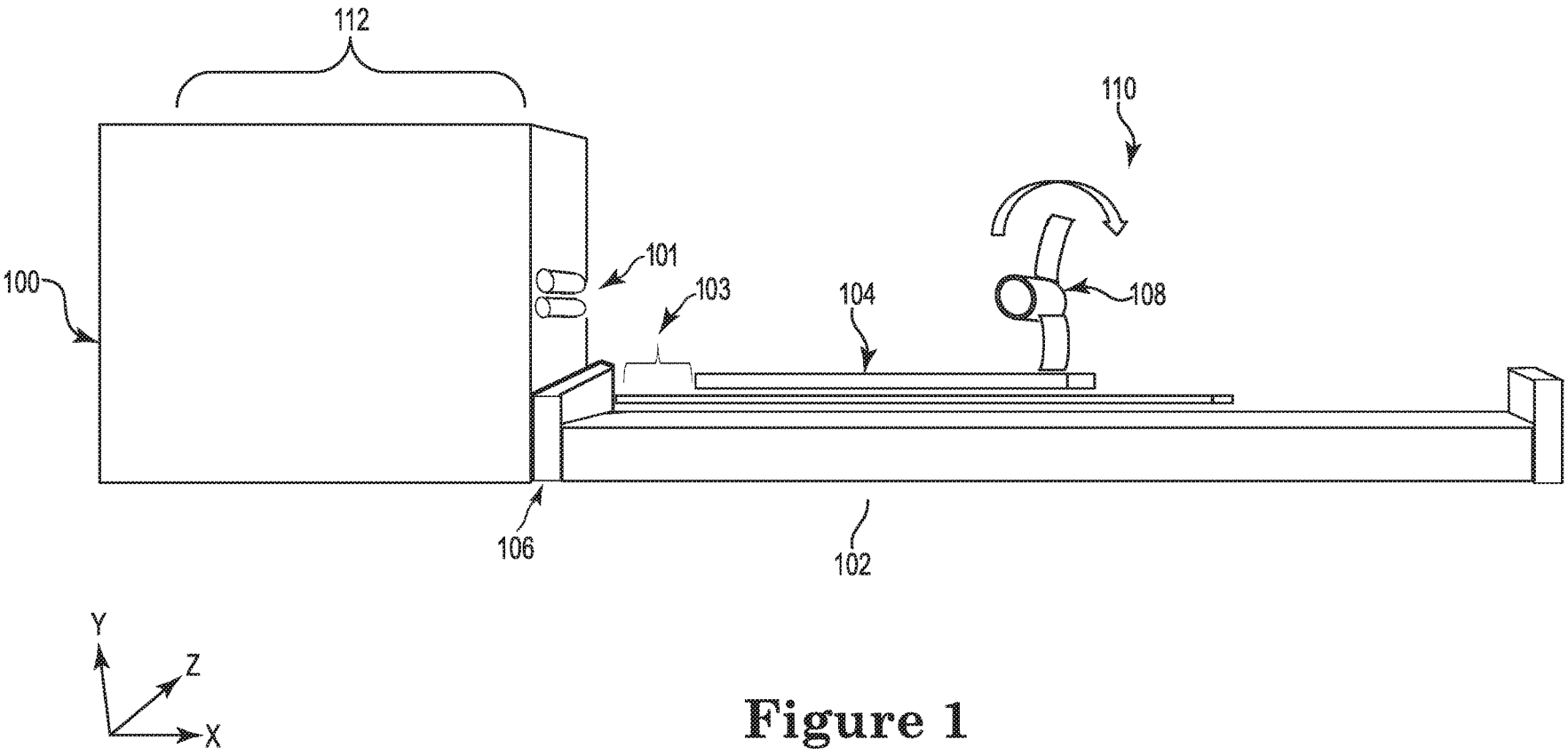
FIG. 1 illustrates an example finishing device including a paddle roller for moving print media sheets on a finishing tray.

Printing devices can be utilized to form markings on a print media. As used herein, a printing device includes a hardware device that transfers a print substance on to a print media such as paper. For example, a printing device can include an inkjet printer that can deposit liquid or ink on to the print media to form a marking. As used herein, the term "print media" may include paper, photopolymers, plastics, composite, metal, wood, or the like. For example, a print media sheet may be deposited onto a finishing tray during a print job. A print media sheet may refer to a piece of print media (e.g., a sheet of paper) upon which markings may be formed to make up a physical representation of the output of a print job or a portion of an output of a print job. As used herein, the term "print job" refers to signals or states, which may be stored in a file and/or a set of files, usable to instruct a print device in forming text, images, and/or objects on print media. Among other things, the print job may include information relating to the print media. For example, a print job may include information such as an amount of print media sheets to be used in forming text, images, and/or objects on print media, a size or format (e.g., dimensions) of the printed media sheets, a paper type (e.g., paper weight, thickness, recycled content etc.), of the print media sheets, etc.

As used herein, the term "finishing tray" may refer to a component of the printing device with a surface to collect the print media sheets as a print job progresses. The print media sheets may be aligned and/or arranged (e.g., registered) along an edge to form a stack on the finishing tray such that a finishing operation may be performed on a stack of print media sheets. As used herein, the term "stack" refers to a vertical pile of print media sheets. As should be apparent, a stack of print media sheets may increase in height as a print job progresses (e.g., as subsequent print media sheets are added to the stack). A post-processing action, referred to herein as "finishing," may be performed on a stack of print media sheets corresponding to a print job. For example, a finishing operation may be performed on a stack of print media sheets, including stapling, hole-punching, folding, and/or collating, etc. A finishing operation may be performed on a print job by a finisher, which may be included in a printing device, included in the finishing tray, and/or external to the printing device. As used herein, the term "finisher" refers to a mechanical and/or electrical component to perform finishing operations, in some examples, the finishing device may be a portion of the printing device, and/or the finishing tray.

Print media sheets are transferred from a print zone of a printer (e.g., a portion of a printer for applying a print substance to media, such as a printhead to apply liquid print substance to media) to the finishing tray by a media advance mechanism. As used herein, the term "a media advance mechanism" refers to an assembly of mechanical and/or electrical components to move print media with markings formed thereon to a location outside of the print zone. When the print media sheet is moved by the media advance mechanism to the finishing tray, the print media sheet may not abut the end register of the finishing tray, and this may cause the stack of print media to be misaligned for finishing operations. As used herein, the term "end register" refers to a portion of the finishing tray that may include a raised edge as to align print media sheets as they are moved to the stack of print media sheets on the finishing tray. As print media sheets are aligned against (e.g., abut) the end register, a finishing operation may be applied to the output of the print job (and produce a satisfactory result, such as opposed to an untidy stack of print media).

A paddle roller may be included in a printing device to move the print media sheets from the finishing tray to abut an end register of the finishing tray. As used herein, the term "paddle roller" refers to a device with a compiler drive element that may rotate about an axis to apply a force to a print media sheet to move the print media sheet to abut an end register of the finishing tray. For example, a paddle roller may include a plurality of paddles that may contact the print media sheets during a rotation of the paddle roller. A combination of the rotation force of the paddle roller and the friction between the paddles and the print media sheet may move the print media sheet a distance toward the end register of the finishing tray with each rotation of the paddle roller.

As a print job progresses, the stack of print media sheets may increase in height. As the stack of print media sheets increases in height, a greater amount of force on each print media sheet may be demanded to move the print media sheet to abut the end register of the finishing tray. Said differently, when the stack of print media sheets is low (e.g., during a starting portion of a print job), each rotation of the paddle roller may move the print media sheet a greater distance toward end register of the finishing tray compared to when the height of the print media sheets is high (e.g., during a final or intermediate portion of the print job). For example, when the height of the stack of print media sheets is high (e.g., during a final portion of the print job), each rotation of the paddle roller may move the print media sheet a lesser distance toward the end register of the finishing tray compared to when the height of the stack of print media sheets is low.

Some imaging devices may change a rotation per minute (RPM) (e.g., increasing and/or decreasing RPM) of the paddle roller as the stack of print media sheets increases to compensate for the demand of a greater force on each print media sheet to move toward the end register of the finishing tray as the stack increases in height. For example, the RPM increase may move a print media sheet from stack of the print media sheets to the end register of the finishing tray while a different print media sheet is exiting the print zone via the media advance mechanism. In this example, the increased RPM may cause the print media sheets to become misaligned. Misaligned print media sheets may yield unsatisfactory finishing operations by the finisher (e.g., untidy stapled stacks of print media, etc.). Thus, in some cases, the result of the finishing operation may not be satisfactory, such as because of the misaligned stack (e.g., misaligned staples, missing pages, misaligned hole punching, etc.). When the print media stack is misaligned in the finishing tray, print jobs may be repeated by a user which may waste time and resources.

Printing devices according to this disclosure can include a paddle roller to move print media sheets toward an end register of a finishing tray such that a print media stack is aligned such that a finishing operation may be completed. As a print job progresses, the print media sheet stack may increase in height. When the print media stack reaches a particular height, the printing device may increase a quantity of rotations of the paddle roller per print media sheet and increase the page gap between the print media sheets. As used herein, the term "page gap" refers to an amount of time between a print media sheet leaving the print zone via the media advance mechanism and a new print media sheet entering the print zone. A printing device may adjust the page gap to allow enough time between print media sheets for compiling. In this way, the paddle roller may increase the quantity of rotations per print media sheet as the stack of print media sheets increases. For example, increasing the quantity of paddle roller rotations per print media sheet may move the print media sheet a sufficient distance to align it within the stack to be finished upon completion of the print job. In this way, the print media sheet may be aligned in the stack on the finishing tray before a new print media sheet exits the print zone via the media advance mechanism. Thus, the finisher may accurately complete a finishing operation on the aligned print media sheet stack (e.g., the completed print job).

FIG. 1 illustrates an example finishing device including a paddle roller for moving print media sheets on a finishing tray. As illustrated in FIG. 1, a finishing device 100 may include, a media advance mechanism 101, a tray 102, a print media sheet 104, an end register 106, a paddle roller 108, and a print zone 112. The finishing device 100 may be included as a component of a printing device, or the finishing device 100 may be an external device separate from a printing device. Although not shown in FIG. 1 for clarity and so as not to obscure examples of the disclosure, the print media sheet 104 may include a plurality of print media sheets 104. For example, the print media sheet 104 may be a stack including a plurality of print media sheets 104. As used herein, the print media sheet 104 may be collectively referred to as the print media sheet 104 (e.g., singular), the print media sheets 104 (e.g., plural), and/or the stack of print media sheets 104. The printing device may move an individual print media sheet 104 to a stack on the tray 102.

For example, the finishing device 100 may include a tray 102 that may be connected to the finishing device 100 to receive the print media sheets 104. The tray 102 may be formed from the finishing device 100 as an individual molded piece, directly connected to the finishing device 100 via fasteners, screws, or other means, and/or indirectly connected to the finishing device 100 via another component of the finishing device 100. The tray 102 may include an end register 106 to compile the print media sheets 104 into a stack. The print media sheets 104 may be stacked such that the print media sheets 104 make contact with (e.g., abut) the end register 106.

For example, the end register 106 may include a raised edge and the print media sheets 104 may abut the raised edge, thus, registering the stack of print media sheets 104 into an accurately aligned stack. As used herein, the term "aligned" refers to an arrangement of print media sheets 104 where an edge of the stack of print media sheets 104 are in a substantially straight line so the edges of the individual print media sheets 104 are aligned in a vertical stack. For example, a stack of print media sheets may be accurately aligned when no individual print media sheet 104 protrudes substantially outside of the stack of print media sheets 104. As used herein, the term "compile" refers to creating a stack that is aligned such that the edges of the print media sheets 104 within the stack are evenly aligned with respect to all of the print media sheets 104 in the stack of print media sheets 104. For example, a stack of print media sheets 104 may be compiled when an edge of each print media sheet 104 is aligned against the end register 106. The stack of print media sheets 104 may be evenly aligned when there are no print media sheets 104 that are substantially misaligned (e.g., protruding/overhanging from the stack) with respect to the remaining print media sheets 104.

As used herein, the term "substantially" intends that the characteristic may not be absolute but is close enough so as to achieve the purpose of the characteristic. For example, "substantially aligned" is not limited to absolute alignment and can include variations that are intended to be aligned but may not be precisely aligned. For example, "substantially aligned" print media sheet 104 stacks are closer to being identically uniform than not identically uniform and are stacked such that a finishing operation may be completed. Similarly, "substantially misaligned" can include orientations of the print media sheets 104 included in a stack in such a way as to prevent accurate finishing operations. For example, a stack of print media sheets 104 may be misaligned when a portion of print media sheets 104 are protruding from the stack. The finishing device 100 may utilize a paddle roller 108 to move the print media sheets 104 to form a substantially aligned stack and abut the end register 106 of the tray 102.

The finishing device 100 may include a media advance mechanism 101 to rotate about a negative z-axis and move the print media sheets 104 from a print zone 112 in a positive x-direction to the tray 102. As indicated by the coordinate plane shown in FIG. 1, a positive x-direction can refer to a direction toward the right of the page, a positive z-direction can refer to a direction out of the page, and a positive y-direction can refer to a direction toward the top of the page. A negative x-direction can refer to a direction toward the left of the page, a negative z-direction can refer to a direction into the page, and a negative y-direction can refer to a direction toward the bottom of the page.

The media advance mechanism 101 may deposit a print media sheet 104 a distance 103 away from the end register 106. When a print media sheet 104 is the distance 103 from the end register 106, the print media sheet may not be compiled correctly (e.g., may be misaligned). For example, when a print media sheet 104 is deposited the distance 103 away from the end register 106 of the tray 102, the stack of print media sheets 104 is unable to accurately finish the print job with the finisher of the finishing device 100. The paddle roller 108 of the finishing device 100 may move the deposited print media sheet 104 the distance 103 in the negative x-direction to abut the end register 106.

For example, the paddle roller 108 may rotate about the positive z-axis in a clockwise direction as illustrated by the arrow 110 to move the individual print media sheet 104 a distance 103 in the negative x-direction such that the print media sheet 104 may abut the end register 106 and may be compiled into a stack on the tray 102. In this way, a finishing operation may be applied to the output of the print job (e.g., stapling) because the edge of the stack of print media sheets 104 will be aligned against the end register 106. Although not shown in FIG. 1 for clarity and so as not to obscure examples of the disclosure, the print roller 108 may be attached to the finishing device 100 and/or the tray 102. The paddle roller 108 may be formed from the finishing device 100 (and/or the tray 102) as an individual molded piece, directly connected to the finishing device 100 (and/or the tray 102) via fasteners, screws, or other ways, and/or indirectly connected to the finishing device 100 (and/or the tray 102) via another component of the finishing device 100.

The paddle roller 108 may rotate a first quantity of rotations per print media sheet 104 based on a height of the stack of the print media sheets 104 compiled. For example, the paddle roller 108 may rotate about the positive z-axis and move individual print media sheets 104 of the print media sheets 104 to abut an end register 106 of the tray 102 and form a stack of print media sheets 104, wherein the paddle roller is to rotate a first quantity of rotations per print media sheet 104 in response to a determination that the stack of print media sheets corresponds to a first height. As the finishing device 100 processes a print job comprising a print media sheets 104, the stack of print media sheets 104 will increase in height as the print job progresses. As the height if the print media sheets 104 increases, the distance that an individual print media sheet 104 moves in the negative x-direction per paddle roller 108 rotation may decrease. Thus, the finishing device 100 may increase a quantity of paddle roller 108 rotations per print individual print media sheet 104 such that each print media sheet 104 may be substantially aligned against the end register 106 of the tray 102.

For example, the paddle roller 108 may rotate a second quantity of rotations per print individual print media sheet 104 in response to a determination that the stack of print media sheets 104 corresponds to a second height greater than the first height, the second quantity of rotations being larger than the first quantity of rotations. Further, the finishing device 100 may increase a quantity of paddle roller 108 rotations per print individual print media sheet 104 such that each print media sheet 104 may be substantially aligned against the end register 106 of the tray 102.

For example, the paddle roller 108 is to rotate a third quantity of rotations per the individual print media sheet 104 in response to a determination that the stack of print media sheets corresponds to a third height greater than the second height, the third quantity of rotations. In some examples, the finishing device 100 may increase the page gap to correspond to the registration time per print media sheet 104 when the stack of print media sheets 104 increases in height to compensate for the increased quantity of paddle roller 108 rotations per print media sheet 104.

As used herein, the term "registration time" refers to the amount of time to compile a print media sheet 104 to abut the end register 106. For example, the finishing device 100 may adjust an amount of time between a first print media sheet 104 leaving the print zone 112 via the media advance mechanism 101 and a second print media sheet 104 entering the print zone (e.g., a page gap). For example, increasing the page gap increases the registration time and allows time for the particular quantity of rotations of the paddle roller 108 per print media sheet 104 to be completed before another print media sheet 104 interacts with the paddle roller 108. In this way, the printing device may avoid misalignment of print media stacks 104.

In other examples, the finishing device 100 may alter the first quantity of rotations per individual print media sheet 104 to move a print media sheet to abut the end register 106 of the tray 102 based on a size of an individual print media sheet. In some examples, a print job may include a predetermined amount of print media sheets 104, wherein the predetermined amount of print media sheets 104 is of a predetermined length and a predetermined thickness. For example, a print media sheet 104 having a length of 11 inches (28 cm) may move a distance 103 in the negative x-direction to abut the end register 106 after 2 rotations of the paddle roller 108 at the starting portion of a print job. In contrast, a print media sheet 104 having a length of 24 (61 cm) inches may move the deposited print media sheet 104 a distance 103 in the negative x-direction to abut the end register 106 after 4 rotations of the paddle roller 108 during the starting portion of the print job. While specific example dimensions of print media sheets 104 are discussed herein, it should be understood that the dimensions may vary, and the examples should not be interpreted in a limiting sense.

In other examples, the finishing device 100 may alter the first quantity of rotations per print media sheet 104 based on a paper type (e.g., a thickness) of the individual print media sheet 104. For example, a print media sheet 104 having a thickness of 1 mm may move a distance 103 in the negative x-direction to abut the end register 106 after 2 rotations of the paddle roller 108 at the starting portion of a print job. However, the finishing device 100 may determine that the thickness of the print media sheets 104 may increase the stack height at a different rate and may alter the quantity of rotations of the paddle roller 108 per print media sheet 104 to move the deposited print media sheet 104 the distance 103 in the negative x-direction to abut the end register 106. For example, a print media sheet 104 having a thickness of 5 mm may increase the print media stack 104 height at a different rate than a print media sheet 104 having a thickness of 1 mm. Based on the determined thickness of the print media sheet 104, the finishing device 100 may alter the quantity of paddle roller 108 rotations per print media sheet 104 from 2 to 4 to move the deposited print media sheet 104 a distance 103 in the negative x-direction to abut the end register 106 as the print job progresses. Said differently, the finishing device 100 may determine that a print media sheet 104 having a thickness of 5 mm may have a higher print media sheet 104 stack at the starting portion of a print job compared to a print media sheet 104 having a thickness of 1 mm. Thus, to compensate, the finishing device 100 may alter a quantity of rotations of the paddle roller 108 per print media sheet 104. While specific example thickness of print media sheets 104 are discussed herein, it should be understood that the thickness may vary, and the examples should not be interpreted in a limiting sense.

FIG. 1 describes examples of a finishing device 100 compiling print media sheets 104 from a print job into a substantially aligned stack against the end register 106 such that a finishing operation (e.g., stapling) may be accurately performed on the print media sheets 104 of the print job. The quantity of rotations of the paddle roller 108 are increased to compensate for the height of the print media sheets 104, and a page gap is increased to allow for the registration time per print media sheet 104 to allow the paddle roller 108 sufficient time to move the deposited print media sheet 104 a distance 103 in the negative x-direction to abut the end register 106 to the tray 102.

In some examples, when physical representations of a print job are formed on print media, the result may include a number of print media sheets 204 (e.g., 10, 20, 50, 100, etc. individual print media sheets). FIGS. 2A-2C illustrate an example output of a printing device in tray 202 at different discrete times in the output process. For example, FIG. 2A illustrates a first time (e.g., $t_0$), referred to as a starting portion of the print job, FIG. 2B illustrates a second time (e.g., $t_1$), referred to as an intermediate portion of the print job, and FIG. 2C illustrates a third time (e.g., $t_2$), referred to as a final portion of the print job. It is noted that while only three discrete portions of the print job are illustrated, a print job may include more or less than three discrete portions.

FIG. 2A illustrates an example paddle roller at a starting portion of a print job. FIG. 2A illustrates a paddle roller 208-1 rotating in a counterclockwise direction as indicated by arrow 210 to move print media sheets 204 into a stack at a first height 214-1 on a tray 202 to abut an end register 206 during a starting portion of a print job. Paddle roller 208-1 may rotate a first quantity of rotations per print media sheet for the stack corresponding to the first height 214-1. Although not shown in FIG. 2A for clarity and so as not to obscure examples of the disclosure, the paddle roller 208-1 may be included as a component of a finishing device (e.g., the finishing device 100 of FIG. 1).

For example, a printing device may determine that the output of a print job includes 100 individual print media sheets 204, the stack of print media sheets 204 may be at a first height 214-1 at the starting portion of the print job. In this example, the first height 214-1 may be print media sheets 204 numbered 1-35, and because first height 214-1 is at a starting portion of the print job, the height of the stack of print media sheets 204 may be lower in comparison to the final height of the stack of the print media sheets for the print job (e.g., 100 individual print media sheets 204).

During the starting portion of the print job, the paddle roller 208-1 may rotate a first quantity of rotations of 2 times per print media sheet 204 to move the deposited print media sheet 204 a distance 203 in the positive x-direction to abut the end register 206 of the tray 202. For example, the printing device may set a quantity of rotations of the paddle roller 208-1 per print media sheet 204 for a starting portion of the print job (e.g., print media sheets 204 numbered 1-35), wherein the quantity of rotations moves the deposited print media sheet 204 a distance 203 in the positive x-direction to abut the end register 206 to the tray 202. In some examples, the first quantity of rotations and the first height 214-1 of the stack of print media sheets 204 correspond to a first registration time, and the second quantity of rotations and the second height 214-2 of the stack of print media sheets 204 correspond to a second registration time. As the print job progresses, the printing device may increase the quantity of rotations of the paddle roller 208-1 as the height of the stack of print media sheets 204-1 increases to a second height 214-2.

FIG. 2B illustrates an example paddle roller at an intermediate portion of a print job. FIG. 2B illustrates a paddle roller 208-2 rotating in a counterclockwise direction as indicated by arrow 210 to move print media sheets 204 a distance 203 into a stack at a second height 214-2 on a tray 202 to abut an end register 206 during an intermediate portion of a print job. Although not shown in FIG. 2B for clarity and so as not to obscure examples of the disclosure, the paddle roller 208-2 may be included as a component of a printing device (e.g., the printing device 100 of FIG. 1).

For example, during an intermediate portion of the print job (e.g., print media sheets 204 numbered 35-75), the paddle roller 208-2 may have difficulty moving the deposited print media sheet 204 the distance 203 in the positive x-direction to abut the end register 206 of the tray 202. Said differently, the paddle roller 208-2 may not move the print media sheet 204 the distance 203 for accurate finishing utilizing 2 rotations of the paddle roller 208-2 per print media sheet 204. To compensate for the second height 214-2, the printing device may alter the quantity of rotations of the paddle roller 208-2 per print media sheet 204 for an intermediate portion of the print job (e.g., print media sheets numbered 35-75). For example, the printing device may increase the quantity of paddle roller 208-2 rotations from 2 to 4 rotations per print media sheet 204. To compensate for the increased amount of time 4 rotations per print media sheet 204 takes in comparison to 2 rotations per print media sheet 204, the printing device may increase the page gap to correspond to a registration time to avoid misalignment of the print media stack at a second height 214-2. For example, the printing device may direct a page gap to increase based on the determination that the stack of print media sheets corresponds to the second height of the stack. As the print job progresses, the printing device may increase the quantity of rotations of the paddle roller 208-2 as the height of the stack of print media sheets 204-2 increases to a third height 208-3.

FIG. 2C illustrates an example paddle roller at a final portion of a print job. FIG. 2C illustrates a paddle roller 208-3 rotating in a counterclockwise direction as indicated by arrow 210 to move print media sheets 204 a distance 203 into a stack at a third height 214-3 on a tray 202 to abut an end register 206 during a final portion of a print job. Although not shown in FIG. 2C for clarity and so as not to obscure examples of the disclosure, the paddle roller 208-3 may be included as a component of a printing device (e.g., the printing device 100 of FIG. 1).

For example, during a final portion of the print job (e.g., 75-100 individual print media sheets 204) the paddle roller 208-3 may have difficulty moving a print media sheet 204 a distance 203 in the positive x-direction to abut the end register 206 of the tray 202. Said differently, the paddle roller 208-3 may not move the print media sheet 204 the distance 203 for accurate finishing utilizing 4 rotations of the paddle roller 208-2 per print media sheet 204. To compensate for the third height 214-3, the printing device may alter the quantity of rotations of the paddle roller 208-3 per print media sheet 204 for a final portion of the print job (e.g., 75-100 individual print media sheets 204). For example, the printing device may increase the quantity of paddle roller 208-3 rotations from 4 to 6 rotations per print media sheet 204. To compensate for the increased amount of time 6 rotations per print media sheet 204 takes in comparison to 4 rotations per print media sheet 204, the printing device may increase the page gap to correspond to a registration time to avoid misalignment of the print media 204 stack at the third height 214-3.

While the print job described in conjunction with FIGS. 2A, 2B, and 2C are described as including 100 individual print media sheets 204, it should be understood that a print job may have more or less than 100 individual print media sheets 204. Similarly, a printing device may alter the paddle roller 208 rotations more or less than described in the examples used in conjunction with FIGS. 2A, 2B, and 2C.

FIGS. 2A, 2B, and 2C illustrate the progression of a print job where a quantity of rotations of the paddle roller 208 per print media sheet 204 may increase as the stack height 214 increases. Accordingly, the page gap may be increased to correspond to the registration time increasing as the quantity of rotations of the paddle roller 208 per print media sheet 204 increases to maintain stack alignment such that a finishing operation may be applied to the output of the print job.

Figure 3:
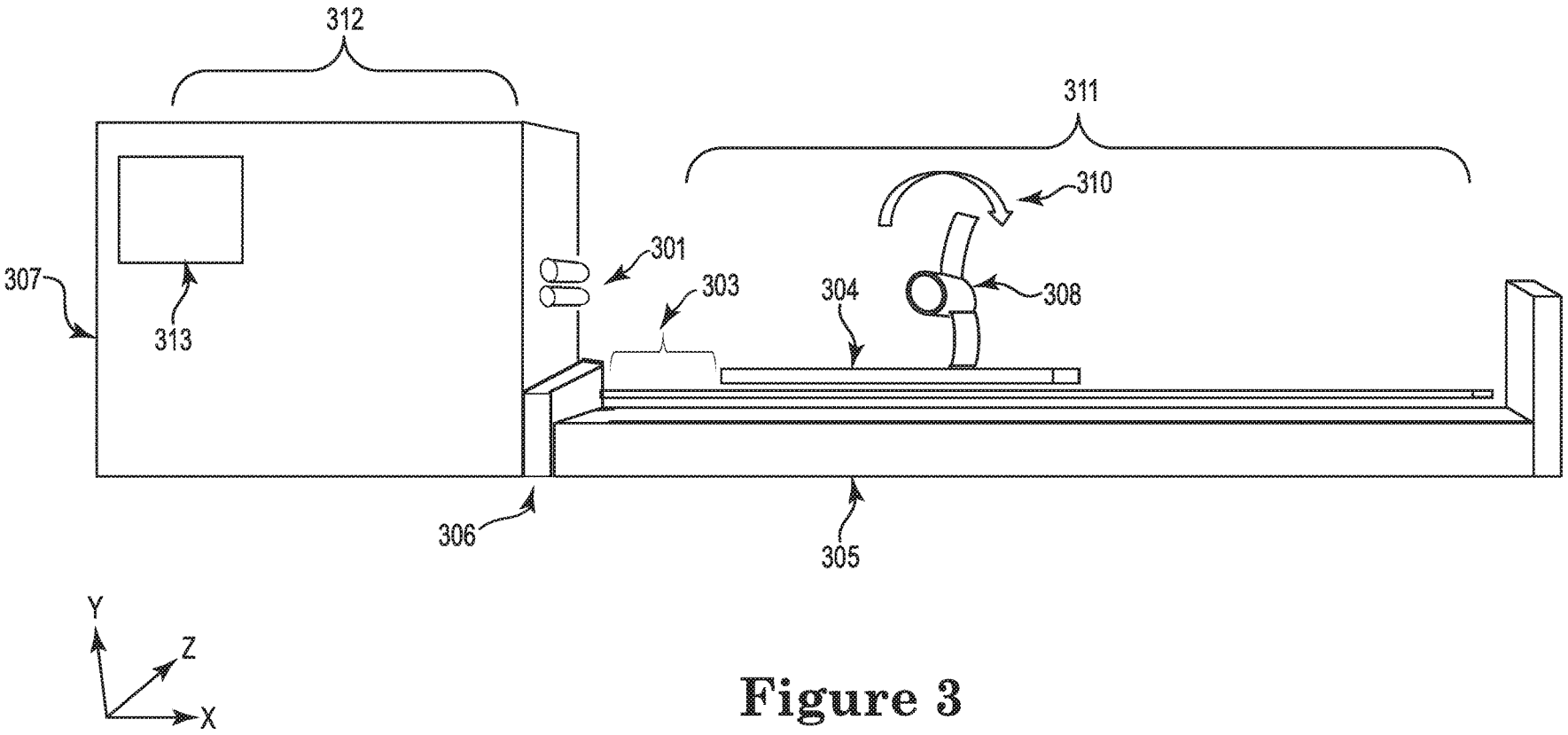
FIG. 3 illustrates an example of a printing device including a controller for moving print media sheets on a finishing tray.

FIG. 3 illustrates an example of a printing device including a controller for moving print media sheets on a finishing tray. As illustrated in FIG. 3, a printing device 307 may include a controller 313, a media advance mechanism 301, a finishing tray 305, a print media sheet 304, an end register 306, a paddle roller 308, a print zone 312, and a finishing zone 311. The printing device may move the print media sheets 304 to a stack on the finishing tray 305. Although not shown in FIG. 1 for clarity and so as not to obscure examples of the disclosure, the printing device 307 may include a print mechanism within the print zone 312 to transfer a print substance to print media sheets 304.

The printing device 307 may include the media advance mechanism 301 to move the print media sheets from the print zone 312 in a positive x-direction to a finishing zone 311, and the plurality of print media sheets 304 may form a stack of print media sheets 304. As used herein, the term "finishing zone" refers to an area on the finishing tray 305 where the media advance mechanism 301 may move the print media sheets 304 after existing the print zone 312. The finishing zone 311 may include the finisher to perform finishing operations on the print media sheets 304 when they have been substantially aligned to abut the end register 306 on the finishing tray 305 for accurate finishing (e.g., stapling). The media advance mechanism 301 may move the individual print media sheet 304 a distance 303 from the end register 306. To avoid misalignment and inaccurate finishing operations, the printing device 307 my utilize the paddle roller 308 to rotate about a negative z-axis in a clockwise direction as illustrated by the arrow 310 to move individual print media sheets 304 the distance 303 in the negative-x direction to abut the end register 306. The printing device may include a controller 313 to make determinations regarding the printing device 307 and/or the print job.

As used herein, the term "controller" refers to a computing device that may contain a processing resource and a memory resource to execute instructions. The controller 313 may be included in the printing device 307, a standalone device, or in a separate device that may be located external to the printing device 307. The controller 313 may determine information relating to the print job and execute instructions based on that information. For example, the information relating to the print job may refer to a number of individual print media sheets 304 (e.g., the output) of a print job, a size of print media sheet 304 (e.g., dimensions), a thickness of the print media sheet 304, and other information related to paper type (e.g., density), etc. For example, the controller 313 may cause the paddle roller 308 to rotate a first quantity of rotations per the individual print media sheets 304 in response to a determination that a stack of print media sheets 304 corresponds to a first height. In this example, the first height may be such that the paddle roller 308 may be able to move a print media sheet the distance 303 to abut the end register 306 of the finishing tray 305 with 2 rotations of the paddle roller 308 per print media sheet 304. As the print job progresses, the stack of print media sheets 304 may increase in height.

For example, the controller 313 may cause the paddle roller 308 to rotate a second quantity of rotations per the individual print media sheets 304 in response to a determination that the stack of print media sheets 304 corresponds to a second height of the stack. For example, the second height of the stack may be such that the paddle roller 308 may be able to move the print media sheets 304 to form a substantially aligned stack and abut the end register 306 of the finishing tray 305 with 4 rotations. Accordingly, the controller 313 may compensate for the increased amount of time 4 rotations per individual print media sheet 304 takes in comparison to 2 rotations per individual print media sheet 304. For example, the controller 313 may increase the page gap to correspond to the registration time to avoiding misalignment of the print media stack 304. In other examples, as the print job progresses, the print media sheet 304 stack may increase a second time.

The controller 313 may cause the paddle roller 308 to rotate a third quantity of rotations per the individual print media sheet 304 in response to a determination that the stack of print media sheets 304 corresponds to a third height of the stack. For example, the third height of the stack may be such that the paddle roller 308 may be able to move the print media sheets 304 the distance 303 to form a substantially aligned stack and abut the end register 306 of the finishing tray 305 with 6 rotations. Accordingly, the controller 313 may compensate for the increased amount of time 6 rotations per individual print media sheet 304 takes in comparison to 4 rotations per individual print media sheet 304, and the controller 313 may increase the page gap to correspond to the registration time to avoid misalignment of the print media stack 304.

FIG. 3 describes examples of a quantity of paddle roller 308 rotations per individual print media sheet 304 increasing such that a stack of print media sheets 304 may be accurately aligned. The page gap is increased accordingly to compensate for the increased registration time of the quantity of rotations of the paddle roller 308. The aligned stack is received on the finishing tray 305 including an end register 306 to compile the stack of print media sheets 304 from the paddle roller 308 and align the stack of print media sheets 304 against the end register 306.

Figure 4:
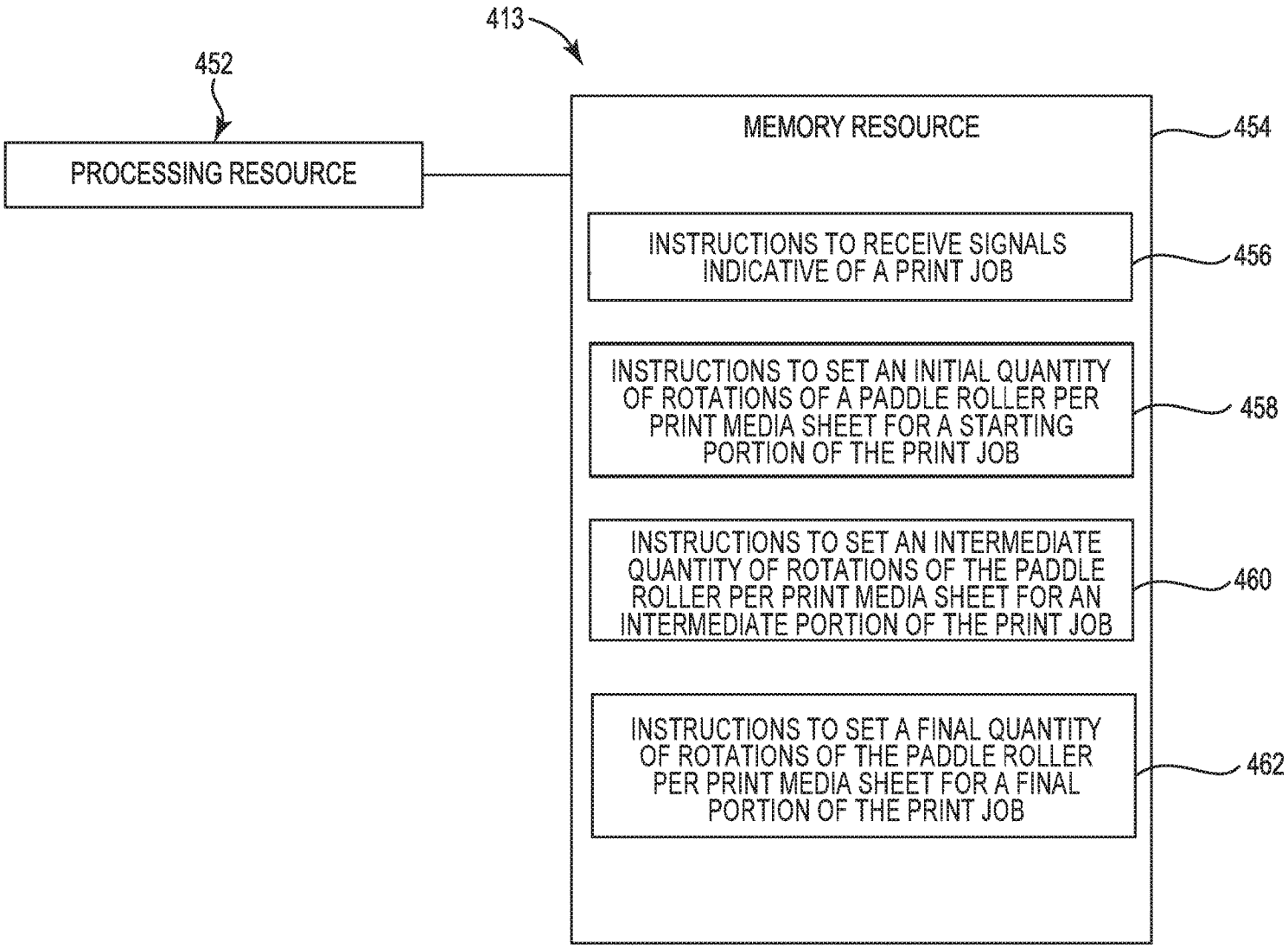
FIG. 4 illustrates an example processing resource and an example memory resource of an example printing device.

FIG. 4 illustrates an example processing resource and an example memory resource of an example printing device. FIG. 4 illustrates an example controller 413, including a processing resource 452 and a memory resource 454. For example, the controller 413 may include a processing resource 452 which may be a central processing unit (CPU), a semiconductor-based microprocessor, and/or other hardware devices suitable for retrieval and execution of instructions stored in a memory resource (e.g., in a non-transitory computer readable medium) 454. The example processing resource 452 may fetch, decode, and execute instructions. As an alternative, or in addition to, retrieving and executing instructions, the example processor may include an electronic circuit that may include electronic components for performing the functionality of executed instructions.

In some examples, the processing resource 452 may be a plurality of hardware processing units that may cause machine-readable instructions to be executed. The processing resource 452 may include central processing units (CPUs) among other types of processing units. The memory resource 454 may be any type of volatile or non-volatile memory or storage, such as random-access memory (RAM), flash memory, storage volumes, a hard disk, or a combination thereof.

The memory resource 454 may store instructions thereon, such as instructions 456, 458, 460, and 462. When executed by the processing resource 452, the instructions may cause the controller 413 to perform specific tasks and/or functions. For example, the memory resource 454 may store instructions 456 which may be executed by the processing resource 452 to cause the controller 413 to receive signals indicative of a print job. In some examples, when a signal indicative of a print job is sent to a printing device (e.g., the printing device 307 of FIG. 3), the controller 413 may determine the amount of individual print media sheets (e.g., print job output) that may be utilized to complete the print job. Further, responsive to reception of signals indicative of the print job, the paddle roller is to cause formation of a stack of print media sheets, and further wherein the stack of print media sheets is to be stapled. For example, the controller 413 may utilize the information about the print job to determine a height of the print media sheet stack (e.g., the print media sheets 304 of FIG. 3).

The memory resource 454 may store instructions 458 which may be executed by the processing resource 452 to cause the controller 413 to set an initial quantity of rotations of a paddle roller per print media sheet for a starting portion of the print job, wherein rotation of the paddle roller is to cause the print media sheet to move to abut an end register of a finishing tray. For example, the controller 413 may cause the paddle roller to rotate a first quantity of rotations per the individual print media sheets in response to a determination that a stack of print media sheets corresponds to a first height at an initial a first time (e.g., to described in conjunction with FIG. 2A) of the print job.

The memory resource 454 may store instructions 460 which may be executed by the processing resource 452 to cause the controller 413 to set an intermediate quantity of rotations of the paddle roller per print media sheet for an intermediate portion of the print job. For example, the controller 413 may cause the paddle roller to rotate a second quantity of rotations per the individual print media sheets in response to a determination that the stack of print media sheets corresponds to a second height of the stack at a second time (e.g., $t_2$ described in conjunction with FIG. 2B) of the print job.

The memory resource 454 may store instructions 462 which may be executed by the processing resource 452 to cause the controller 413 to set a final quantity of rotations of the paddle roller per print media sheet for a final portion of the print job. For example, the controller 413 may cause the paddle roller to rotate a third quantity of rotations per the individual print media sheet in response to a determination that the stack of print media sheets corresponds to a third height of the stack at a third time (e.g., $t_3$ described in conjunction with FIG. 2C) of the print job.

The controller 413 may increase a page gap to correspond to a registration time for the increased amount of time the quantity or rotations per print media sheet takes during the intermediate and final portions of the print job. For example, the rotations per individual print media sheet may take longer during the final portion of the print job (e.g., 6 rotations) in comparison to the intermediate portion (e.g., 4 rotations) per print individual media sheet. The printing device may increase the page gap to correspond to a registration time to avoid misalignment of the print media stack. A finishing operation may be applied to the print job (and produce a satisfactory result, such as opposed to an untidy stack of print media.

Figure 5:
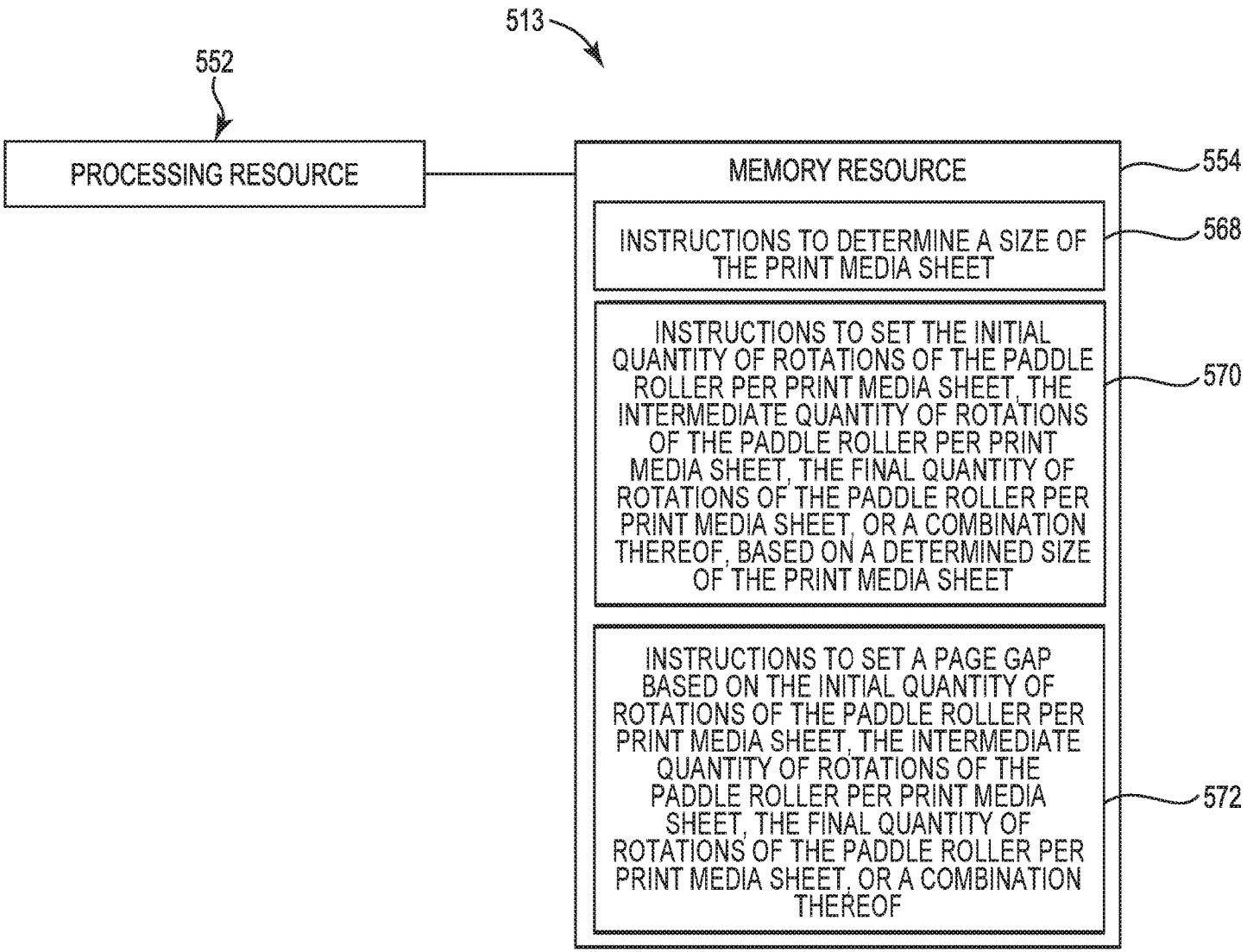
FIG. 5 illustrates an example processing resource and an example memory resource of an example printing device.

FIG. 5 illustrates an example processing resource and an example memory resource of an example printing device. FIG. 5 illustrates, an example controller 513, including a processing resource 552 and a memory resource 554. The memory resource 554 may store instructions thereon, such as instructions 568, 570, and 572. When executed by the processing resource 552, the instructions may cause the controller 513 to perform specific tasks and/or functions. For example, the memory resource 554 may store instructions 568 which may be executed by the processing resource 552 to cause the controller 513 to determine a size (e.g., dimensions) of the print media sheets. For example, the controller 513 may determine that a print job includes print media sheets of a length of 24 inches (61 cm). In this example, the controller 513 may alter a quantity of rotations of a paddle roller to move an individual print media sheet a distance (e.g., the distance 303 of FIG. 3) to form a substantially aligned stack and abut the end register (e.g., the end register 306 of FIG. 3) of the finishing tray (e.g., the finishing tray 305 of FIG. 3).

The memory resource 554 may store instructions 570 which may be executed by the processing resource 552 to cause the controller 513 to set the initial quantity of rotations of the paddle roller per print media sheet, the intermediate quantity of rotations of the paddle roller per print media sheet, the final quantity of rotations of the paddle roller per print media sheet, or a combination thereof, based on a determined size of the print media sheet. For example, the controller 513 may determine that the paddle roller may use a quantity of rotations of 4 per print media sheet based on the determined size. The controller 513 may further increase a page gap to correspond to a registration time based on the progress of the print job.

The memory resource 554 may store instructions 572 which may be executed by the processing resource 552 to cause the controller 513 to set a page gap based on the initial quantity of rotations of the paddle roller per print media sheet, the intermediate quantity of rotations of the paddle roller per print media sheet, the final quantity of rotations of the paddle roller per print media sheet, or a combination thereof. In this way the controller 413 may avoid misalignment of the stack of print media sheets and a finishing operation may be applied to the print job and produce a satisfactory result, such as opposed to an untidy stack of print media.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2.

Elements illustrated in the various figures herein can be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense. As used herein, the designator "N", particularly with respect to reference numerals in the drawings, indicates that a plurality of the particular feature so designated can be included with examples of the disclosure. The designators can represent the same or different numbers of the particular features. Further, as used herein, "a plurality of" an element and/or feature refers to more than one of such elements and/or features.

The above specification, examples and data provide a description of the method and applications and use of the system and method of the present disclosure. Since many examples can be made without departing from the spirit and scope of the system and method of the present disclosure, this specification merely sets forth some of the many possible example configurations and implementations.

What is claimed:

1. A finishing device, comprising:

a tray to receive print media sheets; and a paddle roller to rotate about an axis and move individual print media sheets of the print media sheets to abut an end register of the tray and form a stack of print media sheets, wherein the paddle roller is to:

rotate a first quantity of rotations per print media sheet in response to a determination that the stack of print media sheets corresponds to a first height; and rotate a second quantity of rotations per print media sheet in response to a determination that the stack of print media sheets corresponds to a second height greater than the first height, wherein the second quantity of rotations is larger than the first quantity of rotations.

2. The finishing device of claim 1, wherein the paddle roller is to rotate a third quantity of rotations per print media sheet in response to a determination that the stack of print media sheets corresponds to a third height greater than the second height.

3. The finishing device of claim 1, wherein the first height of the stack of print media sheets corresponds to a first registration time, and the second height of the stack corresponds to a second registration time.

4. The finishing device of claim 3, wherein the second registration time is greater than the first registration time.

5. The finishing device of claim 1, wherein the first quantity of rotations per individual print media sheet to move a print media sheet to abut the end register of the tray is to be altered based on a size of an individual print media sheet.

6. The finishing device of claim 5, wherein the first quantity of rotations per print individual media sheet is further to be altered based on a thickness of an individual print media sheet.

7. A printing device, comprising:

a print mechanism to transfer a print substance to print media sheets;

a media advance mechanism to move the print media sheets from the print mechanism to a finishing zone;

a paddle roller to rotate about an axis and move individual print media sheets of the print media sheets to abut an end register in the finishing zone; and a controller to:

cause the paddle roller to rotate a first quantity of rotations per print media sheet in response to a determination that a stack of print media sheets corresponds to a first height;

cause the paddle roller to rotate a second quantity of rotations per print media sheet in response to a determination that the stack of print media sheets corresponds to a second height of the stack, wherein the second quantity of rotations per print media sheet is greater than the first quantity of rotations per print media sheet, and the second height is greater than the first height; and cause the paddle roller to rotate a third quantity of rotations per print media sheet in response to a determination that the stack of print media sheets corresponds to a third height of the stack, wherein the third quantity of rotations per print media sheet is greater than the second quantity of rotations per print media sheet, and the third height is greater than the second height.

8. The printing device of claim 7, wherein the first quantity of rotations and the first height of the stack of print media sheets correspond to a first registration time, and the second quantity of rotations and the second height of the stack of print media sheets correspond to a second registration time.

9. The printing device of claim 7, wherein a page gap is to increase based on the determination that the stack of print media sheets corresponds to the second height of the stack.

10. The print device of claim 9, wherein a registration time is altered based on an increase in the page gap.

11. The printing device of claim 7, wherein the printing device alters the first quantity of rotations of the paddle roller per print media sheet based on a size of the individual print media sheets.

12. A non-transitory machine readable medium storing instructions executable by a processing resource to cause the processing resource to:

receive signals indicative of a print job;

set an initial quantity of rotations of a paddle roller per print media sheet for a starting portion of the print job, wherein rotation of the paddle roller is to cause the print media sheet to move to abut an end register of a finishing tray;

set an intermediate quantity of rotations of the paddle roller per print media sheet for an intermediate portion of the print job, wherein the intermediate quantity of rotations per print media is greater than the initial quantity of rotations per print media, and the intermediate portion of the print job corresponds to a height of a print media stack greater than a height of a print media stack of an initial portion of the print job; and set a final quantity of rotations of the paddle roller per print media sheet for a final portion of the print job, wherein the final quantity of rotations per print media is greater than the intermediate quantity of rotations per print media, and the final portion of the print job corresponds to a height of a print media stack greater than the height of the print media stack of the intermediate portion of the print job.

13. The medium of claim 12, further comprising instructions executable by the processing resource further to:

determine a size of the print media sheet; and set the initial quantity of rotations of the paddle roller per print media sheet, the intermediate quantity of rotations of the paddle roller per print media sheet, the final quantity of rotations of the paddle roller per print media sheet, or a combination thereof, based on a determined size of the print media sheet.

14. The medium of claim 12 further comprising instructions executable by the processing resource further to:

set a page gap based on the initial quantity of rotations of the paddle roller per print media sheet, the intermediate quantity of rotations of the paddle roller per print media sheet, the final quantity of rotations of the paddle roller per print media sheet, or a combination thereof.

15. The medium of claim 14, wherein responsive to reception of signals indicative of the print job, the paddle roller is to cause formation of a stack of print media sheets, and further wherein the stack of print media sheets is to be stapled.

16. The medium of claim 12, further comprising instructions executable by the processing resource further to:

determine a thickness of the print media sheet; and set the initial quantity of rotations of the paddle roller per print media sheet, the intermediate quantity of rotations of the paddle roller per print media sheet, the final quantity of rotations of the paddle roller per print media sheet, or a combination thereof, based on a determined thickness of the print media sheet.

* * * * *